US009545183B2

(12) United States Patent
Maurer et al.

(10) Patent No.: US 9,545,183 B2
(45) Date of Patent: Jan. 17, 2017

(54) MOBILE FLOOR CLEANING MACHINE

(71) Applicant: Alfred Kärcher GmbH & Co. KG, Winnenden (DE)

(72) Inventors: Bernhard Maurer, Steinheim (DE); Rainer Schaefer, Leutenbach (DE); Eugen Class, Murrhardt (DE)

(73) Assignee: Alfre Kärcher GmbH & Co. KG, Winnenden (DE)

( * ) Notice: Subject to any disclaimer, the term of this patent is extended or adjusted under 35 U.S.C. 154(b) by 516 days.

(21) Appl. No.: 14/038,279

(22) Filed: Sep. 26, 2013

(65) Prior Publication Data

US 2014/0026336 A1 Jan. 30, 2014

Related U.S. Application Data

(63) Continuation of application No. PCT/EP2011/054848, filed on Mar. 29, 2011.

(51) Int. Cl.
*A47L 11/40* (2006.01)

(52) U.S. Cl.
CPC ..... *A47L 11/4091* (2013.01); *A47L 11/40* (2013.01)

(58) Field of Classification Search
CPC .. A47L 11/34; A47L 11/4088; A47L 11/4083; A47L 11/4044; A47L 11/30; A47L 11/4091; A47L 11/40
See application file for complete search history.

(56) References Cited

U.S. PATENT DOCUMENTS

| | | | | |
|---|---|---|---|---|
| 6,098,241 | A * | 8/2000 | Wood | A47L 9/0018 15/323 |
| 6,425,958 | B1 * | 7/2002 | Giddings | A47L 11/03 134/21 |
| 6,510,582 | B1 * | 1/2003 | Yoo | A47L 9/0009 15/323 |
| 2004/0226578 | A1 * | 11/2004 | Guest | A47L 11/4044 134/10 |
| 2011/0023918 | A1 * | 2/2011 | Kelle | B08B 3/026 134/115 R |

FOREIGN PATENT DOCUMENTS

| | | |
|---|---|---|
| CN | 87206036 | 6/1988 |
| CN | 2119189 | 10/1992 |
| DE | 297 13 993 U1 | 12/1998 |
| EP | 1 310 204 A2 | 5/2003 |

* cited by examiner

*Primary Examiner* — Robert Scruggs
(74) *Attorney, Agent, or Firm* — Womble Carlyle Sandridge & Rice LLP

(57) ABSTRACT

A mobile floor cleaning machine is provided having an integrated floor cleaning tool. In order to provide a floor cleaning machine of this kind with improved handling capability, the floor cleaning machine can include an accessory retainer for cleaning accessories, which has at least one accommodating part, which is fastened to the floor cleaning machine, and at least one retaining part, which can be connected to the accommodating part, for retaining the cleaning accessories.

40 Claims, 6 Drawing Sheets

MOBILE FLOOR CLEANING MACHINE

CROSS-REFERENCE TO RELATED APPLICATIONS

This application is a continuation of international application number PCT/EP2011/054848, filed on Mar. 29, 2011, which is incorporated herein by reference in its entirety and for all purposes.

FIELD OF THE INVENTION

The present invention relates to a mobile floor cleaning machine having an integrated floor cleaning tool, in particular a scrubbing machine or a mobile sweeping machine.

BACKGROUND OF THE INVENTION

In the present case, a mobile floor cleaning machine is understood to mean a floor cleaning machine having a chassis that has at least three wheels or rollers. The chassis can but need not be driven by motor. The floor cleaning machine may for example be a so-called walk-behind machine, which may be controlled by the user from behind, a so-called ride-on floor cleaning machine, or a so-called step-on floor cleaning machine, which may be controlled by the user standing on the machine.

An object underlying the present invention is to provide a floor cleaning machine of the type mentioned at the outset with improved handling capability.

SUMMARY OF THE INVENTION

In an aspect of the invention, a mobile floor cleaning machine has an integrated floor cleaning tool and comprises an accessory retainer for cleaning accessories, which has at least one accommodating part, which is fastened to the floor cleaning machine, and at least one retaining part, which can be connected to the accommodating part, for retaining the cleaning accessories.

BRIEF DESCRIPTION OF THE DRAWING FIGURES

The foregoing summary and the following description may be better understood in conjunction with the drawing figures, in which.

DETAILED DESCRIPTION OF THE INVENTION

Figure 1:
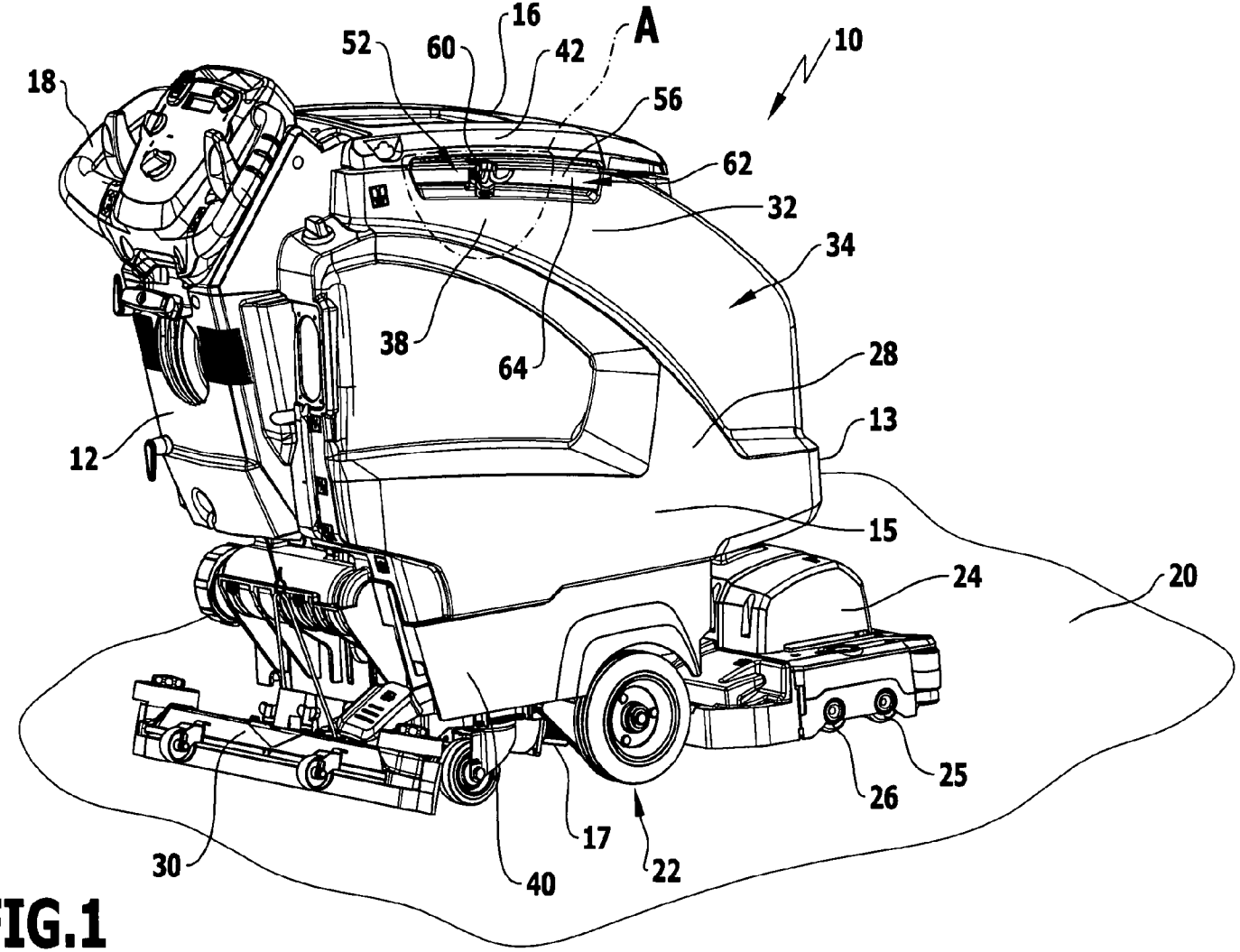
FIG. 1 shows a perspective illustration of a floor cleaning machine in accordance with the invention, including an accessory retainer for retaining cleaning accessories.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a mobile floor cleaning machine having an integrated floor cleaning tool. The mobile floor cleaning machine comprises an accessory retainer for cleaning accessories, which has at least one accommodating part, which is fastened to the floor cleaning machine, and at least one retaining part, which can be connected to the accommodating part, for retaining the cleaning accessories.

The accessory retainer makes it possible for a user to take with the floor cleaning machine cleaning accessories such as a cloth, broom, brush pan, bucket, mop, etc. in order when necessary to clean the floor surface that is to be cleaned, or indeed the floor cleaning machine itself, with the cleaning accessories. The cleaning accessories are retained on the floor cleaning machine by means of the accessory retainer, with the result that the user is saved from taking the cleaning accessories separately, in particular carrying them himself or herself. In order to attach the cleaning accessories to the floor cleaning machine, the accessory retainer includes at least one accommodating part and at least one retaining part that can be connected thereto. This makes it possible to use the accessory retainer as required, wherein the at least one retaining part is only connected to the at least one accommodating part if cleaning accessories are to be taken with the floor cleaning machine. The at least one accommodating part is fastened to the floor cleaning machine and in this way forms a defined coupling point on the floor cleaning machine for the at least one retaining part. Thus, the user can attach the at least one retaining part with cleaning accessories at a defined position on the floor cleaning machine. On the one hand, this makes it easier for the user to handle the accessory retainer. On the other, the floor cleaning machine can thus be protected from damage, since it is possible to avoid the user fastening the at least one retaining part at an unsuitable position on the floor cleaning machine, using unsuitable connecting elements, and in so doing damaging, for example, a bearing structural element, a storage container for cleaning fluid or an electrical device of the floor cleaning machine.

In an advantageous embodiment of the floor cleaning machine in accordance with the invention, the at least one retaining part may be connected to the at least one accommodating part in force- and/or positively-locking manner. This enables a structurally simple configuration and simple handling of the accessory retainer. To this end, the at least one retaining part and the at least one accommodating part each have a connecting element which can cooperate with a connecting element, constructed to correspond thereto, of the accommodating part and the retaining part respectively.

It has proved advantageous for simple handling of the accessory retainer if the at least one retaining part can be clamped to the at least one accommodating part and the cooperating connecting elements are accordingly clamping elements.

As an alternative or in addition, it has also proved advantageous if the at least one retaining part may be latched to the at least one accommodating part and the cooperating connecting elements are accordingly latching elements.

Preferably, the at least one retaining part may be suspended in the at least one accommodating part, wherein the at least one retaining part may in particular take the form of a retaining bracket or spring clamp, i.e., of a so-called "clip". The at least one retaining part may for example be connected to the at least one accommodating part by being suspended therein and preferably clamped and/or latched thereto. A construction of this kind for the floor cleaning machine enables a structurally simple embodiment and handling of the accessory retainer.

It is advantageous if the at least one retaining part can be connected releasably to the at least one accommodating part. If cleaning accessories no longer have to be taken along with the floor cleaning machine, the user can release the at least one retaining part from the at least one accommodating part, for example by releasing a clamping or latching between the retaining part and the accommodating part or by releasing the retaining part from its suspension on the accommodating part.

It is favorable if the at least one accommodating part is arranged laterally on the floor cleaning machine. This creates the possibility of making the accessory retainer and hence also the cleaning accessories accessible to a user in a simple manner. In the present case, the term "lateral" may relate to a longitudinal side, a front side, a rear side, a top side or an underside of the floor cleaning machine.

In the present case, indications of position and direction such as "top", "front", "rear", "longitudinal side", "horizontal" or similar are to be understood in relation to a principal direction of movement of the floor cleaning machine in a position of use in which the floor cleaning machine is in contact with the floor surface to be cleaned by means of the rolling arrangement.

Preferably, the at least one accommodating part is arranged on a longitudinal side of the floor cleaning machine. On the longitudinal side, even bulky cleaning accessories and/or a plurality of cleaning accessory articles may be retained on the floor cleaning machine. In particular in the case of walk-behind floor cleaning machines, which may be controlled from behind, this means the user retains free access to operating elements thereof. Moreover, a clear view of the cleaning region lying in front of the floor cleaning machine, in the direction of cleaning, is ensured for the user if cleaning accessories are retained on a longitudinal side of the floor cleaning machine.

As an alternative or in addition, it can be provided for the at least one accommodating part to be arranged at the top of the floor cleaning machine. This gives the user easier access to the cleaning accessories and makes it simpler also to carry bulky cleaning accessories such as brooms or mops. In particular, the least one accommodating part is arranged on the top of a longitudinal side of the floor cleaning machine.

It may be provided for the accessory retainer to have more than just one accommodating part, wherein the two or more accommodating parts are in particular constructed to be identical or symmetrical in relation to one another and are arranged on the floor cleaning machine.

In an advantageous embodiment of the floor cleaning machine, it has proved favorable if the accessory retainer has two retaining parts which are arranged on mutually opposite sides, in particular longitudinal sides, of the floor cleaning machine. This makes it possible to carry greater quantities of cleaning accessories.

Advantageously, the at least one accommodating part is arranged on the floor cleaning machine such that it is offset in relation to an external contour of the floor cleaning machine in the direction of the center thereof. As a result of this, the at least one accommodating part does not project beyond the external contour of the floor cleaning machine, for example at the longitudinal side thereof. Cleaning accessories that are retained on the at least one accommodating part by means of the at least one retaining part thus project less far or not at all beyond the external contour of the floor cleaning machine. Consequently, the floor cleaning machine may be handled in a manner which is simpler and more maneuverable.

It is favorable if the at least one accommodating part is arranged on a housing that is comprised by the floor cleaning machine in order to achieve a structurally simple configuration of the floor cleaning machine. In the present case, the term "housing" is understood to describe both a cover of the floor cleaning machine such as a hood, lid, top wall or similar, and also a container that is comprised by the floor cleaning machine. The container may for example be a storage container for cleaning fluid or a dirt container for cleaned-off material, in particular a dirty liquid container for cleaning liquid mixed with dirt particles, or a sweepings container for swept-up material.

Preferably, the at least one accommodating part is formed on the housing, for example on a side wall of the housing. This makes possible a structurally particularly simple configuration of the floor cleaning machine. To this end, the housing in particular takes the form of a plastics molded part.

In general, it may be provided for the at least one accommodating part to be constructed in one piece, in particular as a one-piece plastics molded part.

It is favorable if the housing includes two wall portions which are oriented at an angle to one another, and if the at least one accommodating part is formed on the housing at a region at which the two wall portions merge into one another. The at least one accommodating part can for example, as explained below, have at least one connecting element in the form of a projection, for cooperating with a corresponding connecting element of the at least one retaining part. A projection of this kind can be formed on the housing in the region at which the wall portions oriented at an angle to one another merge, in a simple manner from a manufacturing point of view, without undercuts in a mold for making the housing having to be present. To this end, the mold may for example have two mold parts which are joined together at the region of merging and which, when the housing is removed from the mold, are moved away from the molded housing in two different directions. The at least one accommodating part may then be shaped in a structurally simple way in the region of a parting line between the mold parts, which do not need undercuts for the shaping of projections on the at least one accommodating part. This make the manufacture of the at least one accommodating part considerably simpler. The wall portions adjoin one another for example at an angle of approximately 90°.

It may in particular be provided for the at least one accommodating part to be formed on the housing in the region at which a side wall portion of the housing and a top wall portion of the housing merge into one another. In particular, the side wall portion is part of a longitudinal side wall of the housing. The top wall portion may for example be arranged at the top of a container wall of the floor cleaning machine.

Preferably, the at least one accommodating part is of elongate construction in order to create the possibility of connecting more than just one retaining part of the appropriate dimensions to the at least one accommodating part. This makes it possible to retain a plurality of cleaning accessory articles on the floor cleaning machine.

It is advantageous if the at least one accommodating part is of elongate construction in the horizontal direction or substantially in the horizontal direction in order to retain cleaning accessory articles horizontally next to one another on the floor cleaning machine.

It has proved advantageous if the at least one accommodating part takes the form of a rail, for example a suspension rail and/or a clamping rail. At least one retaining part and preferably a plurality of retaining parts may be latched, clamped and/or suspended on the rail. Movability of the at least one retaining part in the longitudinal direction of the rail may also be provided. This creates the possibility of aligning two or more retaining parts in relation to one another and in relation to the at least one accommodating part in a user-friendly manner such that cleaning accessory articles which are each retained thereon may be retained without hampering one another.

It has already been mentioned that the at least one accommodating part may include at least one connecting element. It is favorable if the at least one accommodating part comprises or forms at least one projecting connecting element for cooperating with at least one connecting element, constructed in a manner corresponding thereto, of the at least one retaining part. The at least one projecting connecting element, for example a rib or bead, makes it possible for example to suspend the at least one retaining part on the at least one accommodating part by means of a corresponding connecting element on the retaining part that engages around or behind the connecting element.

As already mentioned, it is advantageous if, in the condition in which it is connected to the at least one accommodating part, the at least one retaining part is movable in relation to the at least one accommodating part. This makes it possible to align the at least one retaining part in relation to the at least one accommodating part as needed, for example depending on the size and type of the cleaning accessory article to be retained. As an alternative or in addition, it is possible to connect a plurality of retaining parts to the at least one accommodating part and to align these in relation to one another and in relation to the accommodating part.

Preferably, the at least one retaining part is mounted displaceably on the at least one accommodating part in order to enable a particularly defined movement of the at least one retaining part in relation to the at least one accommodating part. To this end, the at least one accommodating part takes the form for example of the rail mentioned above, and the at least one retaining part is for example in the form of a retaining bracket that may be suspended in the rail, in particular in the form of a spring clamp.

In a concrete embodiment of the at least one floor cleaning machine, it has proved favorable in practice if the dimension of the at least one accommodating part is approximately 5 times to approximately 15 times as long in the longitudinal direction thereof as the dimension of the at least one retaining part, preferably approximately 10 times as long.

Preferably, the at least one accommodating part is of rigid construction in order to impart as much robustness thereto as possible. In particular if the at least one accommodating part is formed on the housing of the floor cleaning machine, this can also result in a high level of robustness of the housing.

It is favorable if the at least one retaining part is constructed to be at least partly elastically deformable, for example in order to suspend, clamp and/or latch it on the at least one accommodating part with elastic deformation.

The at least one retaining part advantageously has a carrier element and at least one connecting element fastened thereto, for cooperating with at least one connecting element, constructed in a manner corresponding thereto, of the at least one accommodating part.

The at least one connecting element can be brought into engagement with the at least one connecting element of the at least one accommodating part preferably in force- and/or positively-locking manner, for example by latching or clamping.

In a concrete implementation of the floor cleaning machine in practice, it has proved favorable if the at least one connecting element is constructed to be hook-like. This makes it possible for example to suspend the at least one retaining part on at least one accommodating part, wherein the hook-like connecting element engages around or behind a connecting element, constructed in a manner corresponding thereto, of the accommodating part.

Preferably, the at least one connecting element is constructed to be elastically deformable. This allows the at least one retaining part, in particular in combination with the embodiment last described, to be given the function of a spring clamp, a so-called "clip". This makes possible a structurally simple configuration of the accessory retainer.

In particular, in the case of the last two embodiments of the floor cleaning machine mentioned, the at least one connecting element is favorably fastened on a side of the carrier element remote from the at least one accommodating part. This makes it possible, in a structurally simple manner, to ensure sufficient elastic deformability of the at least one connecting element.

Preferably, the at least one retaining part includes two connecting elements which are arranged at a spacing from one another, for respectively cooperating with a connecting element of the at least one accommodating part. This makes possible a more reliable connection of the at least one retaining part to the at least one accommodating part.

It is advantageous if there is formed between the connecting elements of the at least one retaining part a receptacle into which the at least one accommodating part may be at least partly inserted. This provides the possibility that the two connecting elements engage around the at least one accommodating part, at least in certain regions, from two sides, wherein the two connecting elements may each be in force- and/or positively-locking engagement with the at least one accommodating part. If at least one of the two connecting elements is elastically deformable, the receptacle may be enlargeable in order to connect and release the at least one retaining part to and from the at least one accommodating part.

In a concrete implementation of the floor cleaning machine in practice, it has proved favorable if only one of the connecting elements of the at least one retaining part engages around or behind the connecting element, which cooperates therewith, of the at least one accommodating part when the latter is in the condition of being connected to the at least one retaining part. For example, it may be provided for the at least one retaining part to be suspended on the at least one accommodating part by means of a hook-like connecting element, by engaging around or behind the corresponding connecting element. By means of the further connecting element, the retaining part may be secured in this position on the accommodating part by frictional fit, for example in clamping manner.

It may be provided for the connecting elements of the at least one retaining part to be fastened on different sides of the carrier element.

Preferably, the at least one connecting element is formed in one piece with the carrier element. This makes possible a structurally simple configuration of the accessory retainer.

It is advantageous if the carrier element comprises or forms at least one abutment member for abutting against the at least one accommodating part. This allows a defined relative positioning of the at least one retaining part and the at least one accommodating part in relation to one another to be ensured, wherein the retaining part and the accommodating part abut flat against one another, for example. The abutment member may form a guide member in order to guide the retaining part on the accommodating part when it is displaced in relation thereto.

It may be provided for cleaning accessories to be retained directly on the carrier element. To this end, a retaining element, for example a fork-like or hook-like retaining element, may be fastened to the carrier element.

In an advantageous embodiment of the floor cleaning machine in accordance with the invention, the at least one retaining part comprises at least one retaining element, which is releasably connected to the carrier element, for retaining cleaning accessories on at least one retaining part. This makes it possible to connect the at least one retaining element to the carrier element if cleaning accessories to be retained on the retaining element are to be retained by means of the at least one retaining part. As a result, the accessory retainer is versatile to use. In order to release cleaning accessories from the floor cleaning machine, it may be provided for the at least one retaining element to be released from the carrier element or, if possible, for the at least one retaining part to be released together with the at least one retaining element from the at least one accommodating part. The carrier element and the at least one connecting element, to a certain extent, together form an adapter element in order to connect the retaining element to the at least one accommodating part.

The at least one retaining element is preferably arranged on the at least one retaining part on a side remote from the at least one accommodating part, in order to simplify the structural embodiment of the accessory retainer and to make cleaning accessories accessible to the user in a simpler manner.

The carrier element is connectable to the at least one retaining element for example in force- and/or positively-locking manner, in particular by clamping and/or latching.

It is advantageous if the carrier element includes or forms a receptacle for the at least one retaining element, into which the latter may be inserted and from which the latter may be removed again for release from the carrier element. Conversely, it may also be provided for the at least one retaining element to comprise or form a receptacle into which the carrier element may be inserted and from which the carrier element may be released.

It is favorable if the at least one retaining part includes a plurality of retaining elements of identical construction, similar construction or different construction. In the present case, the term "of similar construction" means that two such retaining elements may have the same basic shape but differ from one another in their dimensions, apart from a connecting member for connecting the retaining element to the carrier element, in order to ensure connection thereto in both cases. An embodiment of the floor cleaning machine having a plurality of retaining elements for each retaining part has proved particularly versatile. Depending on the type and/or size of the cleaning accessories to be retained, the user may select a suitable retaining element, any of which may be connected to the same carrier element. The carrier element, together with the at least one connecting element of the at least one retaining part, thus forms an adapter element for accommodating retaining elements even if they are different.

In order to retain a plurality of different cleaning accessory articles on the floor cleaning machine, it is advantageous if the at least one retaining element includes for example a hook-like, bracket-like, fork-like, comb-like, socket-like, strap-like or clasp-like retaining member for retaining cleaning accessories.

It is favorable if the floor cleaning machine includes a plurality of retaining parts. This makes the accessory retainer and hence the floor cleaning machine more versatile to use.

Figure 2:
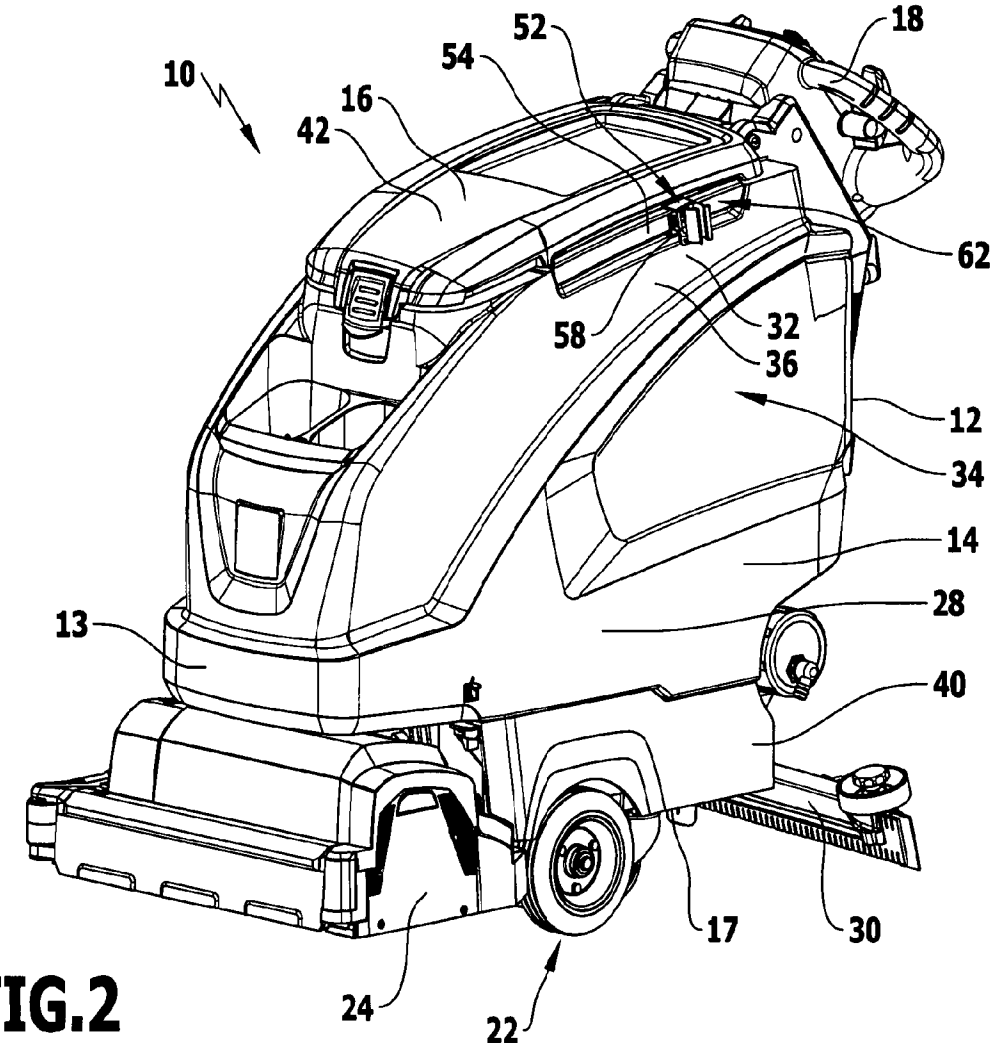
FIG. 2 shows a further perspective illustration of the floor cleaning machine from FIG. 1.
Figure 3:
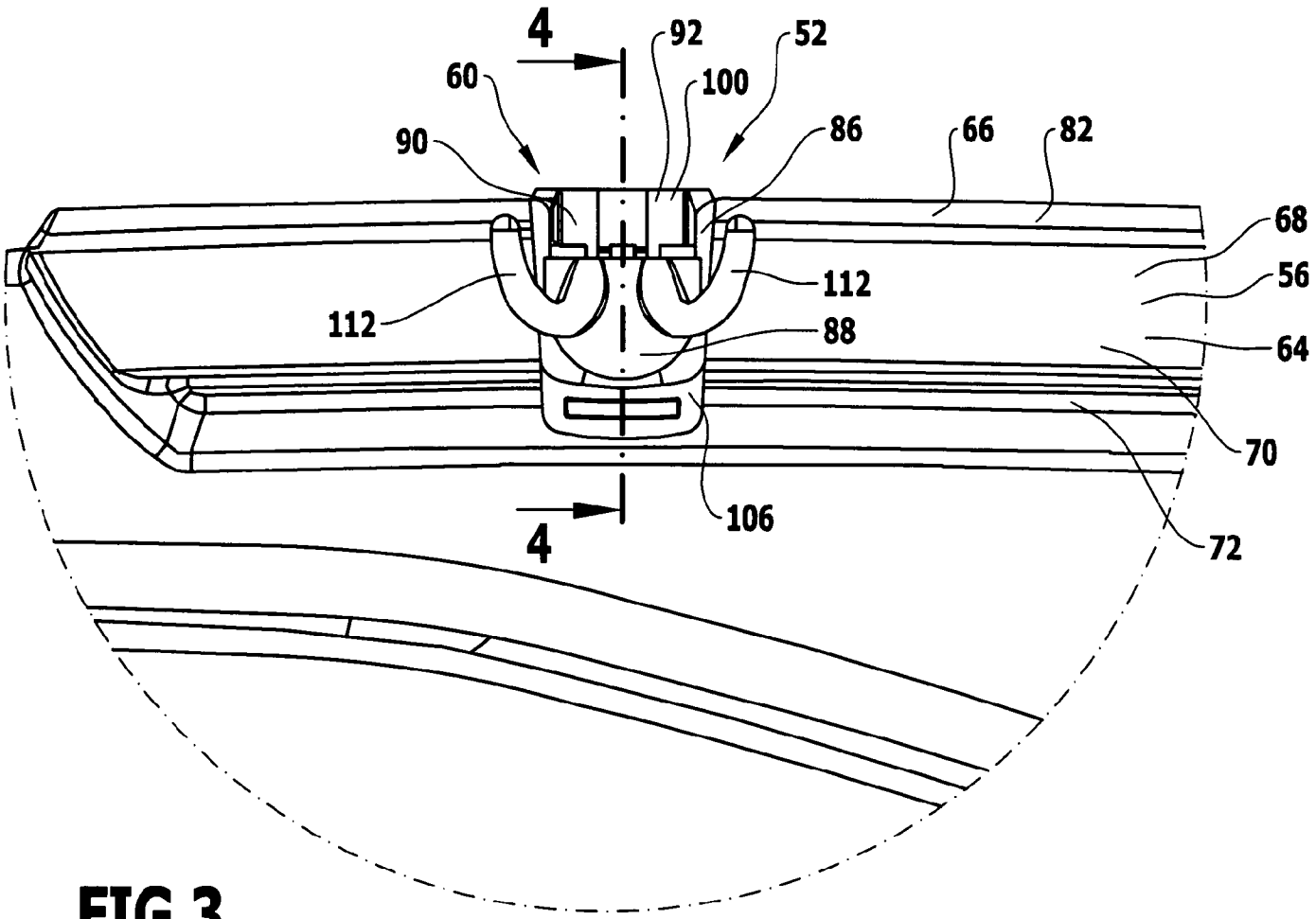
FIG. 3 shows an illustration, on a larger scale, of detail A in FIG. 1, in side view.

FIGS. 1 and 2 each show in perspective a preferred embodiment of a floor cleaning machine in accordance with the invention in the form of a scrubbing machine, given the reference numeral 10. The scrubbing machine 10 has a rear side 12, a front side 13, a left-hand side 14, a right-hand side 15, a top side 16 and an underside 17.

The scrubbing machine 10 is a so-called walk-behind machine, which a user can control by means of an operating unit 18 arranged on the rear side 12. For progressing over a floor surface 20 that is to be cleaned, the scrubbing machine 10 includes a rolling arrangement 22 arranged on the underside 17. The rolling arrangement 22 may be driven, in a manner known per se and for this reason not described, by means of a drive which is not illustrated in the drawing.

In the present case, indications of position and direction such as "rear side", "front side", "top", "bottom", "horizontal" and similar are to be understood in relation to a position of the scrubbing machine 10 in use in which it is in contact with the floor surface 20 by means of the rolling arrangement 22.

For cleaning the floor surface 20, the scrubbing machine 10 has an integrated cleaning tool 24 which is arranged at the bottom on the front side 13, in the form of a brush head which includes two brush rollers 25 and 26 that may be driven in rotation. By means of the brush rollers 25 and 26, dirt may be loosened from the floor surface 20. To enhance the cleaning effect, a cleaning fluid, in particular water, which is stored in a storage container 28 of the scrubbing machine 10 is used.

The mixture of cleaning fluid and dirt can be drawn off by suction by means of a suction device 30 arranged on the rear side 12, in a manner known per se, under the action of a suction unit (not shown) of the scrubbing machine 10, and transferred into a dirty liquid container 32.

The storage container 28 and the dirty liquid container 32 are accommodated in a common housing 34 of scrubbing machine 10, this housing 34 taking the form of a plastics molded part.

The housing 34 extends almost from the rear side 12 to the front side 13 and from the left-hand side 14 to the right-hand side 15, and forms stepped side walls 36 and 38 respectively on these. The housing 34 is placed on a chassis 40 of the scrubbing machine 10 for retaining the rolling arrangement 20, the cleaning tool 24 and the suction device 30.

Figure 4:
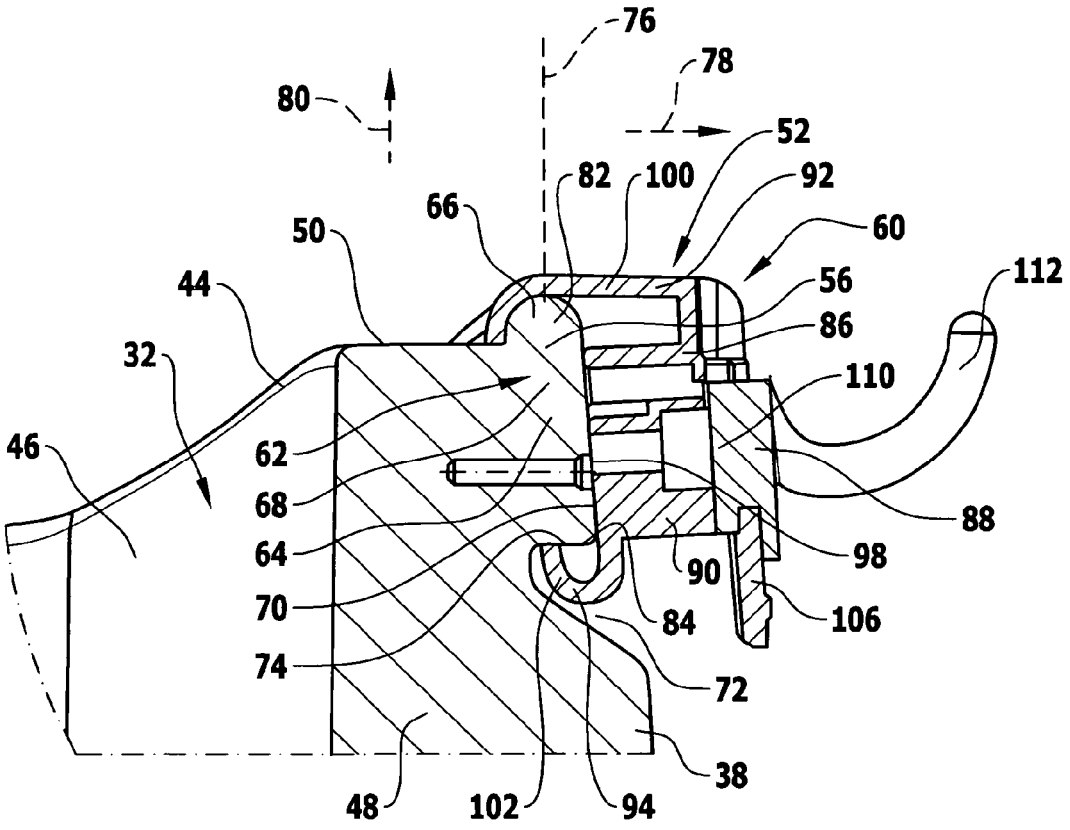
FIG. 4 shows a sectional view along the line 4-4 in FIG. 3.

On the top side 16, the scrubbing machine 10 includes a lid 42 in order to cover the top of the dirty liquid container 32. In the closed condition, the lid 42 covers over a top opening 44 of the dirty liquid container 32, and access to a tank interior 46 defined by the latter is possible through the opening 44 (FIG. 4).

The tank interior 46 is enclosed laterally by a tank wall 48 formed by the housing 34. On the left-hand side 14 and the right-hand side 15 respectively, the tank wall 48 forms part of the stepped and approximately vertically extending side wall 36 and 38 respectively. At the top, facing the lid 42, the tank wall 48 forms a top wall portion 50 which surrounds the opening 44 and is covered over by the lid 42 in the closed condition of the latter. The wall portion 50 is directed approximately at a right angle to the side wall 38.

As mentioned, the floor surface 20 may be cleaned using the scrubbing machine 10. However, in some cases it is desirable, for use of the scrubbing machine 10, to carry cleaning accessories for manually cleaning the floor surface 20 and for cleaning the scrubbing machine 10 itself. The cleaning accessories, which are known per se and not illustrated in the drawing, may be for example a cloth, broom, brush pan, bucket, mop or similar. To make it easier for the user to take cleaning accessories with the scrubbing machine 10, the scrubbing machine 10 includes an accessory retainer 52 by means of which cleaning accessories may be retained on the scrubbing machine 10.

The accessory retainer 52 includes two accommodating parts 54 and 56 which are arranged symmetrically in relation to one another on the scrubbing machine 10 in respect of the longitudinal center plane of the latter. For this reason, only the accommodating part 56 will be discussed below. Further, the accessory retainer 52 includes two retaining parts 58 and 60, of which the retaining part 60 will be discussed below, as well as its differences from the retaining part 58.

The accommodating part 56 is arranged in a region 62 at which the top wall portion 50 and the upper region of the side wall 38 merge into one another on the right-hand side 15. The accommodating part 56 in particular takes the form of an elongate rail 64 which is formed in one piece with the housing 34 in the region 62 of merging. The rail 64 extends along the top side of the housing 34, approximately in the horizontal direction, and runs in the longitudinal direction of the scrubbing machine 10.

The rail 64 includes a rib 66 which projects upwards from the top wall portion 50 and runs along its longitudinal extent. Below the rib 66, the rail 64 includes a lateral portion 68 which forms an upper portion of the right-hand side wall 38 in the region 62 of merging. For this reason, the lateral portion 68 includes a flat lateral abutment member 70 on the right-hand side 15.

Below the lateral portion 68, a groove-like recess 72 extending parallel to the longitudinal direction of the rail 64 is made in the side wall 38. In cross section, the recess 72 is approximately in the shape of a trapezium turned through 90°. At the top the recess 72 is delimited by a flat lower abutment member 74 which is defined by the bottom of the lateral portion 68.

The lateral portion 68 and hence the rail 64 are moreover offset in relation to the side wall 38, in the direction of the longitudinal center plane of the scrubbing machine 10. Thus, the rail 64 has an offset in the direction of the longitudinal center plane, in relation to an external contour of the scrubbing machine 10 on the right-hand side 15. In the region of the recess 72, the right-hand side wall 38 extends without undercuts, with the result that the only undercut occurring when the rail 64 is shaped is created by the rib 66.

In the region 62 of merging, the rail 64 can thus be formed on the housing 34 in a structurally simple manner by making a die parting line 76 at the rib 66. The die parting line 76, illustrated diagrammatically by a dashed line in FIG. 4, defines a boundary between two mold parts which are used to make the housing 34 and are not illustrated in the drawing. When the housing 34 is shaped, the two mold parts can adjoin one another along the die parting line 76. When the housing 34 is removed from the mold, a first mold part may for example be moved away from the housing 34 in a horizontal direction, symbolized by an arrow 78, and a second mold part may be moved away in a vertical direction symbolized by an arrow 80. Because the two mold parts are moved away from one another in directions 78 and 80 which are directed perpendicular to one another in order to remove the housing 34 from the mold, the undercut formed by the rib 66 may be of a structurally simple shape without the need to provide undercuts in one of the two mold parts.

For releasably connecting the retaining part 60 to the rail 64, the rib 66 forms a connecting element 82 and the lower abutment member 74 forms a connecting element 84 of the rail 64.

Figure 5:
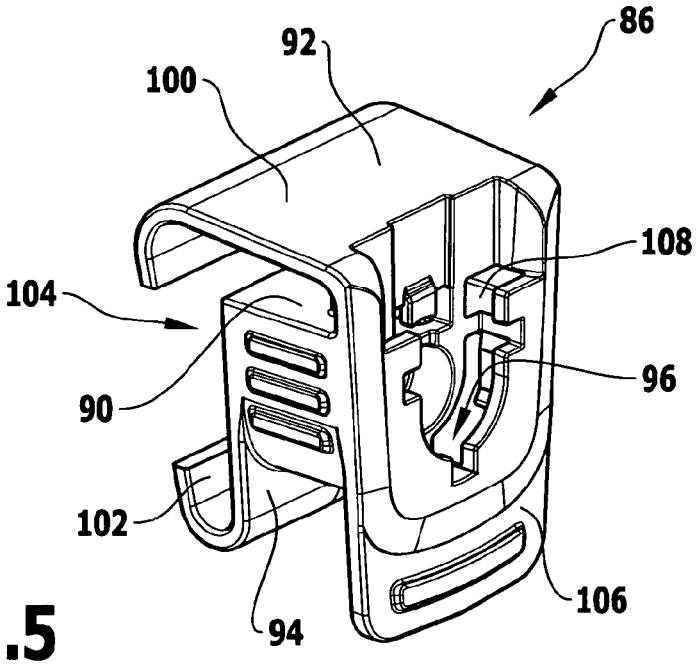
FIG. 5 shows a perspective illustration of an adapter element of the accessory retainer of the floor cleaning machine from FIG. 1.
Figure 6:
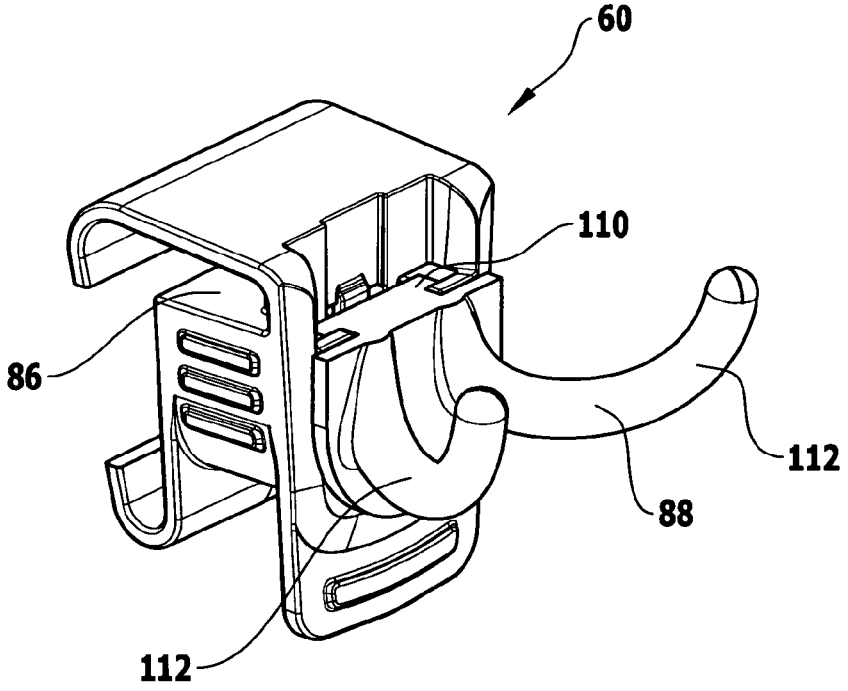
FIG. 6 shows a retaining part of the accessory retainer of the floor cleaning machine in FIG. 1 in perspective illustration, including the adapter element from FIG. 5 and a first retaining element.

The retaining part 60 which is illustrated in perspective in FIG. 6 includes a one-piece adapter element 86 and a one-piece retaining element 88, each made for example of a plastics material. The adapter element 86 serves to connect the retaining part 60 to the rail 64, and the retaining element 88 is provided for retaining cleaning accessories on the retaining part 60. The adapter element 86, which is illustrated separately in perspective in FIG. 5, has an approximately cuboid carrier element 90 to which two connecting elements 92 and 94 are fastened and in which there is a receptacle 96 for the retaining element 88. On its side facing the rail 64, the carrier element 90 includes a flat abutment member 98 for abutting against the lateral abutment member 70 of the rail 64 when the retaining part 60 is connected to the rail 64 (FIG. 4).

The connecting element 92 takes the form of a gripping arm 100 which is hook-shaped in cross section and is fastened at the top of the carrier element 90, on the side thereof remote from the abutment member 98. The gripping arm 100 extends in the transverse direction of the adapter element 86, beyond the carrier element 90, and projects beyond the abutment member 98, its free end forming a downwardly curved hook. The gripping arm 100 is elastically deformable and may be deflected in the vertical direction in relation to the carrier element 90.

The further connecting element 94 is fastened at the bottom of the carrier element 90, on the side thereof that includes the abutment member 98. The connecting element 94 takes the form of a hook 102 that is U-shaped in cross section. The hook 102 projects down from the carrier element 90 and is curved at the free end in the direction of the gripping arm 100. In the transverse direction of the adapter element 86, the hook 102 projects less far beyond the carrier element 90 than the gripping arm 100. Unlike the gripping arm 100, the hook 102 is substantially inelastic.

The adapter element 86 forms a receptacle 104 for part of the rail 64, between the gripping arm 100 and the hook 102. Because of the resilient nature of the gripping arm 100, the receptacle 104 is variable in size. This makes it possible to connect the adapter element 86 and hence the retaining part 60 to the rail 64 in releasable manner. To this end, the gripping arm 100 may cooperate with the rib 66 and the hook 102 may cooperate with the lower abutment member 74.

During connection, the user may arrange the adapter element 86 on the rail 64 such that the gripping arm 100 engages behind the rib 66 by means of its free end, so the retaining part 60 is suspended on the rail 64. First of all, the free end of the hook 102 bears against the lower end of the lateral abutment member 70. As a result of a force directed in the direction of the floor surface 22 and exerted on the adapter element 86, the gripping arm 100 is elastically deformed. This results in the above-mentioned enlarging of the receptacle 104, with the result that the rail 64 can be inserted in certain regions into the receptacle 104. During this, the free end of the hook 102 is moved about the lower end of the lateral abutment member 70, such that the free end of the hook 102 comes into the groove-like recess 72. The gripping arm 100 is elastically deformed again, making the receptacle 104 smaller, until the free end of the hook 102 comes into frictional engagement with the lower abutment member 74. The gripping arm 100 is then in frictional and positively-locking engagement with the rib 66. The abutment member 98 of the carrier element 90 further comes into flat abutment against the lateral abutment member 70 of the rail 64 (FIG. 4).

Because of its construction and mode of operation, the retaining part 60 may be regarded to a certain extent as a spring clamp, i.e., as a so-called "clip" which can be suspended on the rail 64, and which because of the elastic properties of the gripping arm 100 may be suspended and fastened in clamping manner on the rail 64.

This allows cleaning accessories retained on the retaining element 88 to be retained on the scrubbing machine 10 in a user-friendly manner. This means there is no need for a user to take the cleaning accessories along separately or, in particular, to carry them. Because the rail 64 is offset in relation to the side wall 38 in the direction of the longitudinal center plane of the scrubbing machine 10, in some circumstances the cleaning accessories only project beyond the external contour of the scrubbing machine 10 to a relatively small extent or not at all.

In the condition in which it is connected to the rail 64, the retaining part 60 may be displaced in the longitudinal direction thereof, for which purpose the user has to apply a displacement force on the retaining part 60 that is exerted in the longitudinal direction of the rail 64. During this, the positive fit between the adapter element 86 and the rail 64 is maintained but the frictional fit may be overcome by the displacement force from the user in order to displace the retaining part 60. Because the dimension of the retaining part 60 in the longitudinal direction of the rail 64 corresponds approximately to one tenth of the dimension of the latter, the user can if necessary displace the retaining part 60 over a relatively long longitudinal range. While the retaining part 60 is displaced in relation to the rail 64, the abutment members 98 and 70 cooperate as guide members.

Further, it may be provided for further retaining parts to be connected to the rail 64 by way of the retaining part 60 in order to fasten a plurality of cleaning accessory articles to the rail 64 and hence to the housing 34. By displacing the retaining parts in relation to the rail 64, the retaining parts may be aligned in relation to one another and hence in relation to the rail 64 in order if necessary to position cleaning accessories that are retained on the respective retaining parts.

In order to release the retaining part 60 from the rail 64, the retaining part 60 has to be urged by a releasing force in a direction oriented away from the side wall 38. To this end, the adapter element 86 includes a releasing element 106. The releasing element 106 is formed on the carrier element 90 on the side remote from the hook 102 and takes the form of a tongue projecting downwards from the carrier element.

Pulling on the releasing element 106 in a direction oriented away from the side wall 38 causes the free end of the hook 102 to come out of engagement with the lower abutment member 74, with simultaneous elastic deformation of the gripping arm 100. This makes it possible to pivot the free end of the hook 102 about the lower end of the lateral abutment member 70 and hence to release the rail 64 from the receptacle 104. Then, the gripping arm 100 may be released from the rib 66 and the retaining part 60 may be released from its position suspended on the rail 64.

The receptacle 96 for the retaining element 88 on the adapter element 86 is arranged on the opposite side of the carrier element 90 to the abutment member 98 and takes the form of a pocket having an upper insertion opening 108. For cooperating with the receptacle 96, the retaining element 88 has a plate-like fastening member 110 which may be inserted through the insertion opening 108 and into the receptacle 96 and latched therein in positively-locking manner.

If the retaining element 88 is to be released from the carrier element 90, an upwardly directed force may be exerted thereon such that the fastening member 110 comes out of engagement with the receptacle 96 and latching is released. This enables the retaining element 88 to be removed from the receptacle 96 through the insertion opening 108.

As mentioned, the retaining element 88 serves to retain cleaning accessories on the retaining part 60 and hence on the housing 34. To this end, the retaining element 88 includes two hook-like retaining members 112 on which cleaning accessories can be suspended. For example, the retaining members 112 may extend through eyelets arranged in the cleaning accessories.

Figure 7:
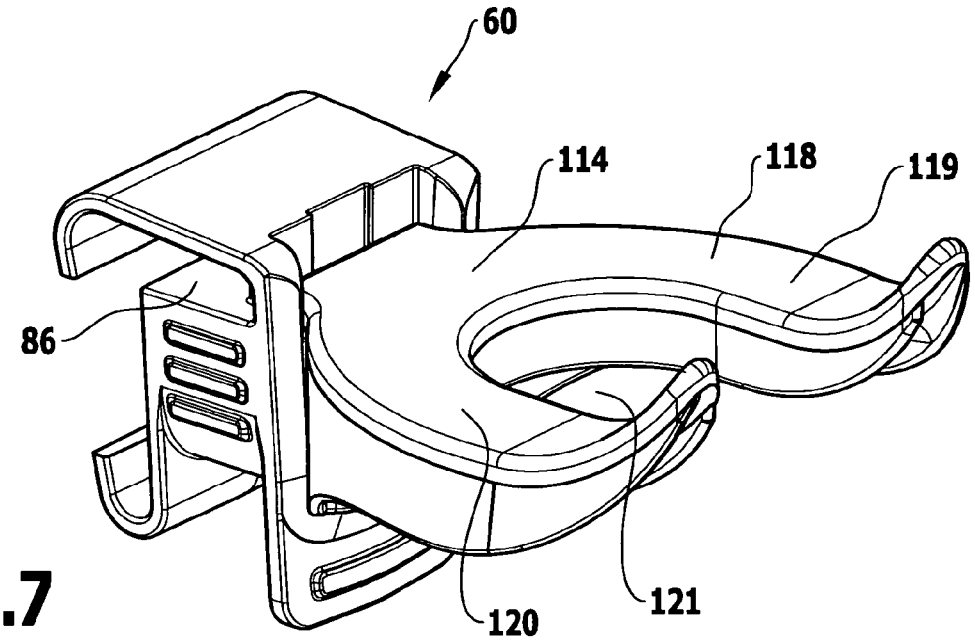
FIG. 7 shows the retaining part from FIG. 6, wherein the adapter element from FIG. 5 is connected to a second retaining element instead of the first retaining element.
Figure 8:
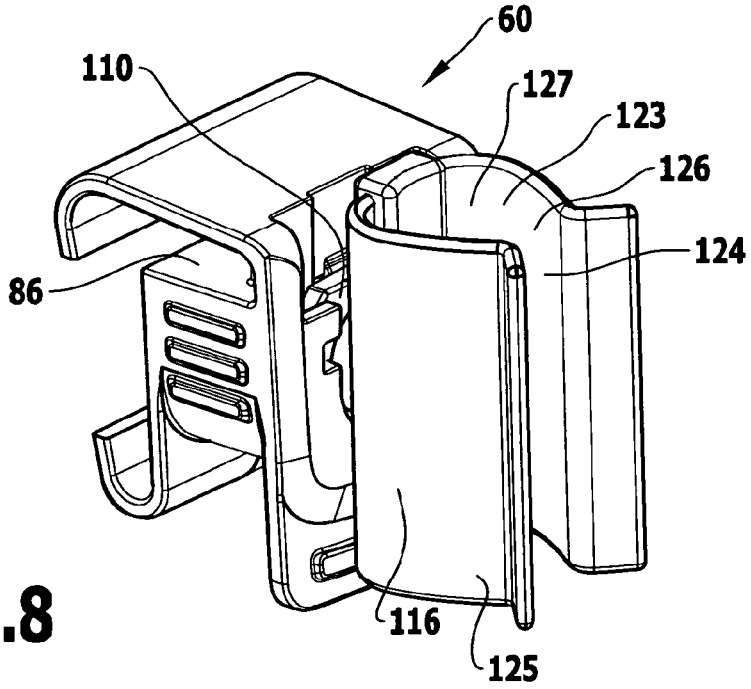
FIG. 8 shows the retaining part from FIG. 6, wherein the adapter element from FIG. 5 is connected to a third retaining element instead of the first retaining element.

In addition to the retaining element 88, the retaining part 60 includes two further retaining elements 114 and 116, which are illustrated in FIGS. 7 and 8, in each case in the condition connected to the adapter element 86. Both retaining elements 114 and 116 include a respective fastening member for connection to the adapter element 86, and this is of identical construction to the fastening member 110. This enables each of the retaining elements 114 and 116 to be connected releasably to the adapter element 86 instead of the retaining element 88, by latching the respective retaining element 88, 114 or 116 to the respective fastening member in the receptacle 96.

The above-mentioned retaining part 58 includes an adapter element which is identical to the adapter element 86 and a retaining element which is identical to the retaining element 116, and is connected to the accommodating part 54. The retaining part 58 may also include further retaining elements.

The retaining element 114 includes a fork-like or horseshoe-like retaining member 118 having two mutually spaced limbs 119 and 120, between which there is arranged a receptacle 121. At the top the retaining member 118 is of planar construction, and the limbs 119 and 120 each taper to a point in the direction of their free ends and are curved upwards. The retaining element 114 in particular serves to fasten cleaning fluid bottles to the housing 34 by way of the retaining part 60, wherein a bottle neck of the cleaning fluid bottle is inserted into the receptacle 121 and a head of the cleaning fluid bottle can abut at the top against the limbs 119 and 120.

The retaining element 116 has a sleeve-like retaining member 123 which extends approximately vertically. The retaining member 123 is breached at the side in the longitudinal direction at an opening 124 and includes two halves 125 and 126. The halves 125 and 126 are movable in relation to one another, since the retaining member 123 is constructed to be elastically deformable as a whole. An elongate article, for example a shaft of a broom or mop, may be inserted through the opening 124 into an intermediate space 127 between the halves 125 and 126 and clamped therein. In this way, the retaining element 116 serves to retain elongate articles such as brooms or mops on the retaining part 60 and hence on the housing 34.

The fact that a plurality of retaining elements 88, 114 and 116 which may where necessary be connected to the adapter element 86 are provided makes the accessory retainer 52 versatile to use. Depending on preference and application, the user can connect the most suitable retaining element 88, 114 or 116 to the adapter element 86 in order to fasten the cleaning accessories to the housing 34. Since, as already mentioned, a plurality of retaining parts 60 can further be connected releasably to the rail 64, the scrubbing machine 10 is characterized by a particularly high level of versatility.

That which is claimed:

1. A mobile floor cleaning machine having an integrated floor cleaning tool, the mobile floor cleaning machine comprising an accessory retainer for cleaning accessories, which has at least one accommodating part, which is fastened to the floor cleaning machine, and at least one retaining part, which is adapted to be connected to the accommodating part, for retaining the cleaning accessories, wherein the at least one accommodating part is of elongate construction wherein, in the condition in which the at least one retaining part is connected to the at least one accommodating part, the at least one retaining part is movable in relation to the at least one accommodating part, and wherein a plurality of retaining parts are connectable to the same accommodating part.

2. The floor cleaning machine in accordance with claim 1, wherein the at least one retaining part is adapted to be connected to the at least one accommodating part in at least one of force- and positively-locking manner.

3. The floor cleaning machine in accordance with claim 1, wherein the at least one retaining part is adapted to be clamped to the at least one accommodating part.

4. The floor cleaning machine in accordance with claim 1, wherein the at least one retaining part is adapted to be latched to the at least one accommodating part.

5. The floor cleaning machine in accordance with claim 1, wherein the at least one retaining part is adapted to be suspended in the at least one accommodating part.

6. The floor cleaning machine in accordance with claim 1, wherein the at least one retaining part is adapted to be connected releasably to the at least one accommodating part.

7. The floor cleaning machine in accordance with claim 1, wherein the at least one accommodating part is arranged laterally on the floor cleaning machine.

8. The floor cleaning machine in accordance with claim 7, wherein the at least one accommodating part is arranged on a longitudinal side of the floor cleaning machine.

9. The floor cleaning machine in accordance with claim 7, wherein the at least one accommodating part is arranged at the top of the floor cleaning machine.

10. The floor cleaning machine in accordance with claim 7, wherein the accessory retainer has two accommodating parts which are arranged on mutually opposite sides of the floor cleaning machine.

11. The floor cleaning machine in accordance with claim 7, wherein the at least one accommodating part is arranged on the floor cleaning machine such that it is offset in relation to an external contour of the floor cleaning machine in the direction of the center thereof.

12. The floor cleaning machine in accordance with claim 1, wherein the at least one accommodating part is arranged on a housing that is comprised by the floor cleaning machine.

13. The floor cleaning machine in accordance with claim 12, wherein the at least one accommodating part is formed on the housing.

14. The floor cleaning machine in accordance with claim 13, wherein the housing includes two wall portions which are oriented at an angle to one another, and in that the at least one accommodating part is formed on the housing at a region at which the two wall portions merge into one another.

15. The floor cleaning machine in accordance with claim 14, wherein the at least one accommodating part is formed on the housing in the region at which a side wall portion of the housing and a top wall portion of the housing merge into one another.

16. The floor cleaning machine in accordance with claim 1, wherein the at least one accommodating part is of elongate construction in the horizontal direction or substantially in the horizontal direction.

17. The floor cleaning machine in accordance with claim 1, wherein the at least one accommodating part takes the form of a rail.

18. The floor cleaning machine in accordance with claim 1, wherein the at least one accommodating part comprises or forms at least one projecting connecting element for cooperating with at least one connecting element, constructed in a manner corresponding thereto, of the at least one retaining part.

19. The floor cleaning machine in accordance with claim 1, wherein the at least one retaining part is mounted displaceably on the at least one accommodating part.

20. The floor cleaning machine in accordance with claim 1, wherein the dimension of the at least one accommodating part is approximately 5 times to approximately 15 times as long in the longitudinal direction thereof as the dimension of the at least one retaining part, preferably approximately 10 times as long.

21. The floor cleaning machine in accordance with claim 1, wherein the at least one accommodating part is of rigid construction.

22. The floor cleaning machine in accordance with claim 1, wherein the at least one retaining part is constructed to be at least partly elastically deformable.

23. The floor cleaning machine in accordance with claim 1, wherein the at least one retaining part has a carrier element and at least one connecting element fastened thereto, for cooperating with at least one connecting element, constructed in a manner corresponding thereto, of the at least one accommodating part.

24. The floor cleaning machine in accordance with claim 23, wherein the at least one connecting element is adapted to be brought into engagement with the at least one connecting element of the at least one accommodating part in at least one of force- and positively-locking manner.

25. The floor cleaning machine in accordance with claim 23, wherein the at least one connecting element is constructed to be hook-like.

26. The floor cleaning machine in accordance with claim 23, wherein the at least one connecting element is constructed to be elastically deformable.

27. The floor cleaning machine in accordance with claim 23, wherein the at least one connecting element is fastened on a side of the carrier element remote from the at least one accommodating part.

28. The floor cleaning machine in accordance with claim 23, wherein the at least one retaining part includes two connecting elements which are arranged at a spacing from one another, for respectively cooperating with a connecting element of the at least one accommodating part.

29. The floor cleaning machine in accordance with claim 28, wherein there is formed between the connecting elements of the at least one retaining part a receptacle into which the at least one accommodating part is at least partly insertable.

30. The floor cleaning machine in accordance with claim 28, wherein only one of the connecting elements of the at least one retaining part engages around or behind the connecting element, which cooperates therewith, of the at least one accommodating part when the latter is in the condition of being connected to the at least one retaining part.

31. The floor cleaning machine in accordance with claim 28, wherein the connecting elements of the at least one retaining part are fastened on different sides of the carrier element.

32. The floor cleaning machine in accordance with claim 23, wherein the at least one connecting element is formed in one piece with the carrier element.

33. The floor cleaning machine in accordance with claim 23, wherein the carrier element comprises or forms at least one abutment member for abutting against the at least one accommodating part.

34. The floor cleaning machine in accordance with claim 23, wherein the at least one retaining part comprises at least one retaining element, which is releasably connected to the carrier element, for retaining cleaning accessories on at least one retaining part.

35. The floor cleaning machine in accordance with claim 34, wherein the at least one retaining element is arranged on the at least one retaining part on a side remote from the at least one accommodating part.

36. The floor cleaning machine in accordance with claim 34, wherein the carrier element includes or forms a receptacle for the at least one retaining element, into which the latter is insertable.

37. The floor cleaning machine in accordance with claim 34, wherein the at least one retaining part comprises a plurality of retaining elements of identical construction, similar construction or different construction.

38. The floor cleaning machine in accordance with claim 34, wherein the at least one retaining element includes a hook-like, bracket-like, fork-like, comb-like, socket-like, sleeve-like, strap-like or clasp-like retaining member for retaining cleaning accessories.

39. The floor cleaning machine in accordance with claim 1, wherein the accessory retainer has a plurality of retaining parts.

40. A mobile floor cleaning machine having an integrated floor cleaning tool, the mobile floor cleaning machine comprising an accessory retainer for cleaning accessories, which has at least one accommodating part, which is fastened to the floor cleaning machine, and at least one retaining part, which is adapted to be connected to the accommodating part, for retaining the cleaning accessories, wherein the at least one retaining part has a carrier element and at least one connecting element fastened thereto, for cooperating with at least one connecting element, constructed in a manner corresponding thereto, of the at least one accommodating part, wherein the at least one retaining part includes two connecting elements which are arranged at a spacing from one another, for respectively cooperating with a connecting element of the at least one accommodating part, and wherein only one of the connecting elements of the at least one retaining part engages around or behind the connecting element, which cooperates therewith, of the at least one accommodating part when the latter is in the condition of being connected to the at least one retaining part.

* * * * *